US007975598B2

(12) United States Patent
Christensen et al.

(10) Patent No.: US 7,975,598 B2
(45) Date of Patent: Jul. 12, 2011

(54) HYDRAULIC VALVE ARRANGEMENT

(75) Inventors: Thorkild Christensen, Soenderborg (DK); Siegfried Zenker, Kirchseeon (DE); Svend Erik Thomsen, Nordborg (DK)

(73) Assignee: Sauer-Danfoss Aps, Nordborg (DK)

( * ) Notice: Subject to any disclaimer, the term of this patent is extended or adjusted under 35 U.S.C. 154(b) by 672 days.

(21) Appl. No.: 11/956,917

(22) Filed: Dec. 14, 2007

(65) Prior Publication Data

US 2008/0245222 A1 Oct. 9, 2008

(30) Foreign Application Priority Data

Dec. 20, 2006 (DE) ..... 10 2006 060 333

(51) Int. Cl.
*F15B 13/042* (2006.01)

(52) U.S. Cl. ..... 91/447

(58) Field of Classification Search ..... 60/445–447; 91/445–447

See application file for complete search history.

(56) References Cited

U.S. PATENT DOCUMENTS

| | | | | |
|---|---|---|---|---|
| 5,454,223 | A | 10/1995 | Tschida et al. | |
| 5,806,312 | A | 9/1998 | Kauss et al. | |
| 5,950,429 | A | 9/1999 | Hamkins | |
| 6,089,248 | A | 7/2000 | Rost | |
| 6,318,079 | B1 * | 11/2001 | Barber | 91/447 |
| 6,854,270 | B2 | 2/2005 | Zenker et al. | |
| 7,328,646 | B2 | 2/2008 | Jensen et al. | |
| 2005/0257519 | A1 | 11/2005 | Jensen et al. | |

FOREIGN PATENT DOCUMENTS

| | | | |
|---|---|---|---|
| DE | 19646428 | A1 | 5/1998 |
| DE | 102 19 717 | B3 | 2/2004 |
| DE | 102004014113 | A1 | 10/2005 |
| DE | 102004025322 | A1 | 12/2005 |

* cited by examiner

*Primary Examiner* — F. Daniel Lopez
(74) *Attorney, Agent, or Firm* — McCormick, Paulding & Huber LLP

(57) ABSTRACT

The invention concerns a hydraulic valve arrangement (1) with a supply connection arrangement comprising a high-pressure connection (P) and a low-pressure connection (T), a working connection arrangement comprising two working connections (A, B), which can be connected to a motor (4), a directional valve arrangement (5) located between the supply connection arrangement (P, T) and the working connection arrangement (A, B), and a compensation valve (15) acted upon in a first activation direction by a pressure in a first pressure chamber (33), which is connected to a load-sensing pipe (LS), and, if required, by a spring (32), and in a second activation direction opposite to the first activation direction by a pressure downstream of the directional valve arrangement (5), said pressure acting in a second pressure chamber (34), the compensation valve (15) having an inlet (14) and an outlet (19). In connection with a post-compensated valve, it is endeavored to adjust the load pressures at the working connections (A, B) in dependence of the direction. For this purpose, each working connection (A, B) is connected to a control system, which amplifies the effect of the pressure in the first pressure chamber (33) on the compensation valve (15) in dependence of a pressure ruling at the working connection (A, B).

10 Claims, 1 Drawing Sheet

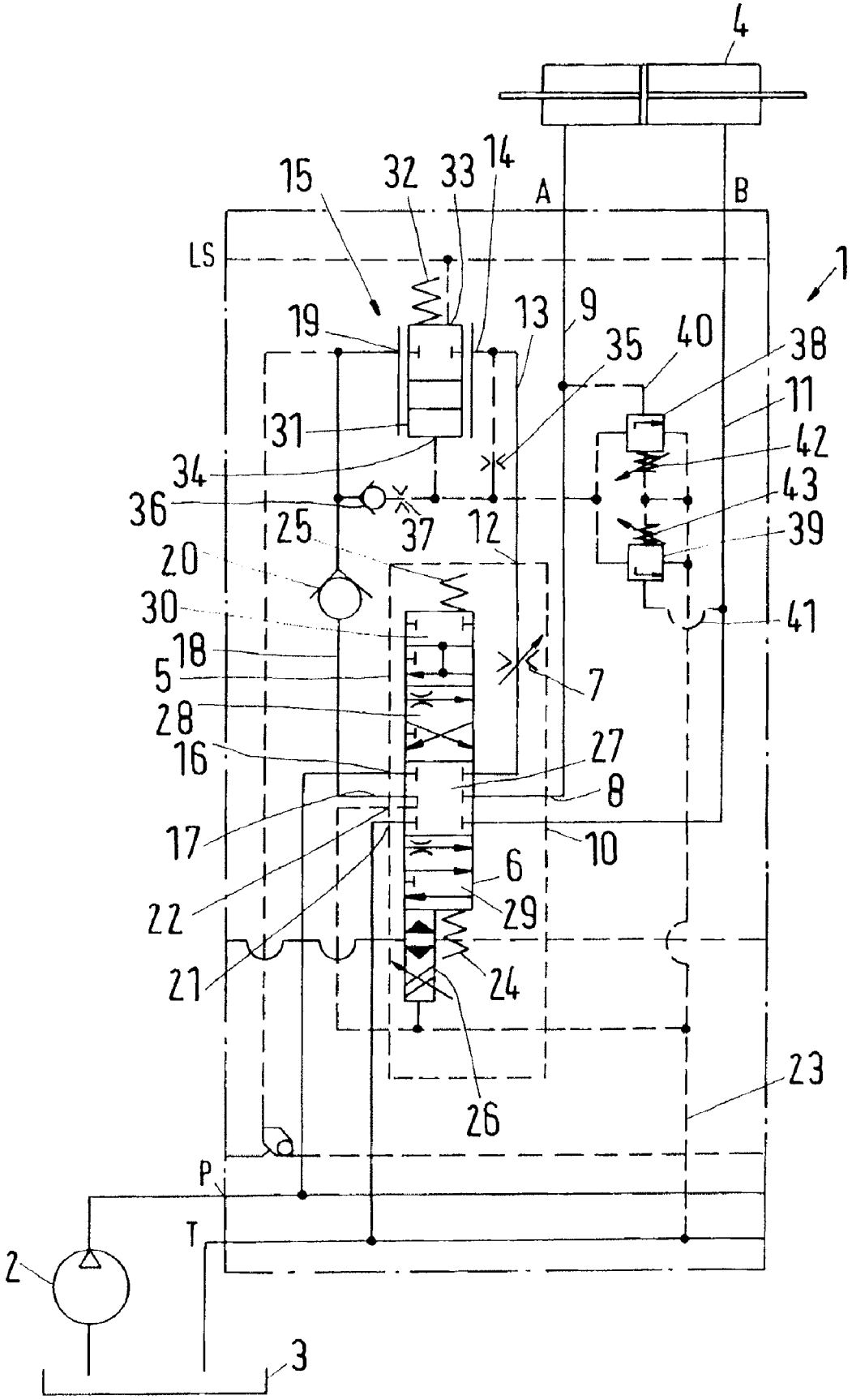
4
15
32
33
14
A
B
LS
1
19
13
9
35
40
38
11
31
42
34
43
36
37
12
39
25
20
41
30
18
5
7
28
27
16
8
17
10
6
22
29
21
24
23
26
P
T
2
3

HYDRAULIC VALVE ARRANGEMENT

CROSS REFERENCE TO RELATED APPLICATION

Applicant hereby claims foreign priority benefits under U.S.C. §119 from German Patent Application No. 10 2006 060 333.8 filed on Dec. 20, 2006, the contents of which are incorporated by reference herein.

FIELD OF THE INVENTION

The invention concerns a hydraulic valve arrangement with a supply connection arrangement comprising a high-pressure connection and a low-pressure connection, a working connection arrangement comprising two working connections, which can be connected to a motor, a directional valve arrangement located between the supply connection arrangement and the working connection arrangement, and a compensation valve acted upon in a first activation direction by a pressure in a first pressure chamber, which is connected to a load-sensing pipe, and, if required, by a spring, and in a second activation direction opposite the first activation direction by a pressure downstream of the directional valve arrangement, said pressure acting in a second pressure chamber, the compensation valve having an inlet and an outlet.

BACKGROUND OF THE INVENTION

Such a hydraulic valve arrangement is, for example, known from DE 102 19 717 B3.

Such a valve arrangement is, for example, required to be able to control a hydraulic motor in two working directions. Such a motor can, for example lift a load or lower it in a controlled manner. With such a motor it is also possible to activate working elements of a hydraulically activated working machine. In connection with an excavator, for example, it is possible to lift or lower an excavator arm or to change the inclination of an excavator shovel in relation to the excavator arm. Another application is, for example, an industrial truck, which has a grab for picking up a load, for example a large paper roll, and another motor, which is suited to lift the load.

The compensation valve in the valve arrangement mentioned above is a so-called "post-compensated" compensation valve, which has the advantage that, in case of parallel activation of two or more valve arrangements of the kind mentioned in the introduction and an insufficient flow of hydraulic fluid, that is, an undersupply, it distributes the hydraulic fluid evenly on all valve arrangements. The fluid flow in each valve arrangement sinks in relation to the predetermined desired values, so that an automatic allocation of the fluid flow into individual part flows occurs. Also with different loads on the motors connected to the valve arrangements the relation between the individual motor movements will be maintained.

SUMMARY OF THE INVENTION

The invention is based on the task of enabling a direction-depending setting of load pressures at the working connections in connection with a post-compensated valve.

With a hydraulic valve arrangement as mentioned in the introduction, this task is solved in that each working connection is connected to a control system, which amplifies the effect of the pressure in the first pressure chamber on the compensation valve in dependence of a pressure ruling at the working connection.

In the valve arrangement mentioned in the introduction, the pressure in the first pressure chamber and, if required, the spring act upon the compensation valve in the closing direction. The control system then ensures that, when a predetermined pressure has been reached in the working connection in question, this effect on the compensation valve is amplified, meaning that the compensation valve throttles further. When the compensation valve throttles further, less hydraulic fluid will reach the working connection and the pressure drops or the pressure increase is limited.

It is preferred that the control system pressure-relieves the second pressure chamber. The pressure in the second pressure chamber counteracts the pressure in the first pressure chamber and, if appropriate, the force of the spring. When the pressure in the second pressure chamber is reduced, the effect of the pressure in the first pressure chamber and, if appropriate, the spring on the compensation valve will be equally amplified. This is a relatively simple way of amplifying this effect without having to use additional means.

Preferably, the control system has a relief valve for each working connection. The relief valve is controlled by the pressure at the working connection and permits pressure to escape from the second pressure chamber. This has the particular advantage that practically no fluid has to be taken from the working connection. The only fluid required is the fluid to be used for opening the relief valve. As, however, here only a signal is concerned, the amount of oil lost is extremely small. Depending on the relief valve used, it can even be zero. Oil will only be discharged from the second pressure chamber.

Preferably, a throttle is located between the second pressure chamber and the directional valve arrangement, and the relief valve is connected between the throttle and the second pressure chamber. This has the advantage that the pressure downstream of the directional valve arrangement can easily be passed on to the second pressure chamber to open the compensation valve, without causing a too large loss of fluid when relieving the pressure chamber. As long as the control system does not permit fluid to flow off, the pressure from the directional valve arrangement travels in a practically unprevented manner into the second pressure chamber to open the compensation valve. When the control system lets fluid escape from the second pressure chamber, the throttle prevents that too much fluid flows out of the directional valve arrangement too.

Preferably, the relief valve has an adjustable opening pressure. In this case, the valve arrangement can be adapted to specific conditions.

Preferably, the relief valve is located between the second pressure chamber and the low-pressure connection. The fluid escaping from the second pressure chamber can then immediately be removed via the low-pressure connection, which usually leads to a tank. There is practically no risk that a fluid jam will occur, which could again lead to a pressure increase at the compensation valve.

Preferably, the outlet of the compensation valve is connected to the second pressure chamber via a non-return valve and a second throttle, the non-return valve opening in the direction of the second pressure chamber. If the control system permits fluid to escape from the second pressure chamber, a very fast pressure drop at the corresponding working connection is achieved. Thus, not only is the compensation valve further throttled, but "excess" fluid is permitted to flow off to allow the pressure to be reduced as fast as possible.

It is also advantageous that the outlet of the compensation valve is connected to the directional valve arrangement via a second non-return valve that opens in the direction of the directional valve arrangement. Load changes at the working connections will then have no influence on the control of the compensation valve. Thus, a more precise control of the load pressures at the working connections can be achieved.

BRIEF DESCRIPTION OF THE DRAWINGS

In the following, the invention is described on the basis of a preferred embodiment in connection with the drawing, showing:

Only FIGURE is a schematic view of a hydraulic valve arrangement.

DETAILED DESCRIPTION OF THE PREFERRED EMBODIMENTS

A hydraulic valve arrangement 1 has a supply connection arrangement with a high-pressure connection P and a low-pressure connection T. The high-pressure connection P is connected to a pump 2. The low-pressure connection T is connected to a tank or a container 3. A hydraulic motor 4 is connected to a working connection arrangement having two working connections A, B. Further, there is a load sensing pipe LS, which carries the highest load pressure existing in the system. This is particularly interesting, if several such valve arrangements 1 are arranged next to each other, each supplying a motor 4.

Between the supply connection arrangement P, T and the working connection arrangement A, B is located a directional valve arrangement 5, which comprises a directional valve 6 and a measuring orifice 7. For reasons of clarity, the directional valve 6 and the measuring orifice 7 are shown as different and spatially separated elements. However, they can also be put together.

The directional valve arrangement 5 has a first outlet 8 that is connected via a pipe 9 to the working connection A, and a second outlet 10 that is connected via a second pipe 11 to the working connection B. Further, the directional valve arrangement has a third outlet 12, which is connected via a pipe 13 to an inlet 14 of a compensation valve 15.

The directional valve arrangement has a first inlet 16, which is connected to the high-pressure connection P. A second outlet 17 of the directional valve arrangement 5 is connected via a pipe 18 to an outlet 19 of the compensation valve 15. In the pipe 18 is located a non-return valve 20 opening in the direction of the inlet 17 of the directional valve arrangement 5. A connection 21 of the directional valve arrangement 5 is connected to the low-pressure connection T. A connection 22 of the directional valve arrangement 5 is connected via a relief pipe 23 to the low-pressure connection T.

The directional valve 6 has two neutral position springs 24, 25 and a drive 26, which can, for example, work electromagnetically. Also a manual activation via a handle, not shown, is possible.

The directional valve 6 has a slide, which is displaceable from the shown neutral position 27, in which the inlets 16, 17 are separated from the outlets 8, 10, 12, into a first working position 28 and into a second working position 29 as well as into a float position 30. In both working positions 28, 29, the first inlet 16 is connected to the outlet 12 leading to the compensation valve 15. In the first working position 28, the second inlet 17 is connected to the second outlet 10 leading to the working connection B, and the working connection A is connected to the low-pressure connection T. In the second working position 29, the second inlet 17 is connected to the first outlet 8 leading to the working connection A, and the second working connection B is connected via the second outlet 10 to the low-pressure connection T. In the float position 30, the two working connections A, B are connected to each other and to the second inlet 17 and the second connection 22, so that the motor 4 can move freely.

The compensation valve has a slide 31, which is acted upon in the closing direction by the force of a spring 32 and the pressure at the load-sensing connection LS acting in a first pressure chamber 33. The spring 32, however, is not absolutely necessary, even though it is advantageous. For reasons of simplification, only the effect of the spring 32 will be described in the following. Thus, at the same time, the effect of the pressure ruling in the pressure chamber 33 will be described. In the opening direction the slide 31 is loaded by a pressure in a second pressure chamber 34. The second pressure chamber 34 is connected via a first throttle 35 to the inlet 14 of the compensation valve 15. Thus, in the second pressure chamber 34, the pressure at the third outlet 12 of the directional valve arrangement 5, that is, the pressure downstream of the measuring orifice 7, is acting.

Further, the second pressure chamber 34 is connected via a non-return valve 36 opening in the direction of the pressure chamber 34 and a second throttle 37 to the outlet 19 of the compensation valve 5.

The second pressure chamber 34 is connected via a first relief valve 38, which can also be called pressure relief valve, to the relief pipe 23, and via a second relief valve 39, which can also be called pressure relief valve, to the relief pipe 23 and thus to the low-pressure connection T. The first relief valve 38 is opened via a control pipe 40, which is connected via the pipe 9 to the working connection A. The second relief valve is opened via a control pipe 41, which is connected via the pipe 11 to the working connection B. Both relief valves 38, 39 are opened, when the pressure at the allocated working connection A, B is larger than the force of a spring 42, 43, which can be set individually for each relief valve 38, 39. Thus, the spring 42 defines for the relief valve 38 the pressure at the working connection A, at which the relief valve 38 opens and relieves the second pressure chamber 34 to the low pressure connection T. The spring 43 defines the pressure at the working connection B, at which the relief valve 39 opens and relieves the second pressure chamber 34 to the low-pressure connection T.

The valve arrangement works as follows:

As long as the directional valve 6 is in the neutral position 27, the third outlet 12 of the directional valve arrangement 5 is pressureless, and the compensation valve 15 is closed. In this connection, it should be noted that the expression "closed" does not mean that the compensation valve 15 seals hermetically. The expression "closed" means that the compensation valve 15 is in its most heavily throttled position. This position is determined by the force of the spring 32 and the pressure at the load-sensing connection LS.

When the directional valve 6 is displaced to one of its two working positions 28, 29, the high-pressure connection P is connected to the inlet 14 of the compensation valve 15. Via the throttle 35 a pressure builds up in the second pressure chamber 34, said pressure counteracting the force of the spring 32 and the pressure in the first pressure chamber 33, which corresponds to the load-sensing pressure. The compensation valve 15 opens so much that the pressure drop over the measuring orifice 7 corresponds to the stand-by pressure minus the force of the spring 32. The pressure adjusted in this manner by the compensation valve 15 is then passed on to one of the two working connections A, B, and the motor 4 is activated. Fluid flowing back from the other working connection A, B is led to the low-pressure connection T.

It may now happen that external influences cause the pressure at the activated working connection A, B to become too high. When the pressure at the working connection A gets so high that it exceeds the force of the spring 42 at the relief valve 38, the relief valve 38 opens, so that fluid from the second pressure chamber 34 can flow off via the relief pipe 23 to the low-pressure connection T. In this case, the compensation valve 15 throttles more heavily. At the same time, fluid will also be led out via the non-return valve 36 and the throttle 37 to the low-pressure connection T, the fluid originating from the outlet 19 of the compensation valve 15. In this manner, it is quickly achieved that the pressure at the working connection A sinks to a maximum value set by the relief valve 38, without requiring other measures. When the pressure in the working connection B gets too high, the same applies for the corresponding activation of the relief valve 39.

As the two relief valves 38, 39 can be set at different response values, it is also possible to limit the load pressure in the two working connections A, B to different values.

The advantage of this embodiment is that no relevant fluid amount has to be withdrawn from the working connections A, B for the control of the relief valves 38, 39. Fluid is merely taken from the second pressure chamber 34, to reduce the pressure in said chamber and to throttle the compensation valve 15 more heavily.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A hydraulic valve arrangement with a supply connection arrangement comprising a high-pressure connection and a low-pressure connection, a working connection arrangement comprising two working connections, which is connected to a motor, a directional valve arrangement located between the supply connection arrangement and the working connection arrangement, and a compensation valve acted upon in a first activation direction by a pressure in a first pressure chamber, which is connected to a load-sensing pipe, and in a second activation direction opposite to the first activation direction by a pressure downstream of the directional valve arrangement, said pressure downstream acting in a second pressure chamber, the compensation valve having an inlet and an outlet, wherein each working connection is connected to a control system, which amplifies the effect of the pressure in the first pressure chamber on the compensation valve in dependence of a pressure ruling at the working connection;

wherein the control system pressure-relieves the second pressure chamber.

2. The valve arrangement in accordance with claim 1, wherein the control system has a relief valve for each working connection.

3. The valve arrangement in accordance with claim 2, wherein a throttle is located between the second pressure chamber and the directional valve arrangement, and the relief valve is connected between the throttle and the second pressure chamber.

4. The valve arrangement in accordance with claim 2, wherein the relief valve has an adjustable opening pressure.

5. The valve arrangement in accordance with claim 2, wherein the relief valve is located between the second pressure chamber and the low-pressure connection.

6. A hydraulic valve arrangement with a supply connection arrangement comprising a high-pressure connection and a low-pressure connection, a working connection arrangement comprising two working connections, which is connected to a motor, a directional valve arrangement located between the supply connection arrangement and the working connection arrangement, and a compensation valve acted upon in a first activation direction by a pressure in a first pressure chamber, which is connected to a load-sensing pipe, and in a second activation direction opposite to the first activation direction by a pressure downstream of the directional valve arrangement, said pressure downstream acting in a second pressure chamber, the compensation valve having an inlet and an outlet, wherein each working connection is connected to a control system, which amplifies the effect of the pressure in the first pressure chamber on the compensation valve in dependence of a pressure ruling at the working connection;

wherein the outlet of the compensation valve is connected to the second pressure chamber via a non-return valve and a second throttle, the non-return valve opening in the direction of the second pressure chamber.

7. A hydraulic valve arrangement with a supply connection arrangement comprising a high-pressure connection and a low-pressure connection, a working connection arrangement comprising two working connections, which is connected to a motor, a directional valve arrangement located between the supply connection arrangement and the working connection arrangement, and a compensation valve acted upon in a first activation direction by a pressure in a first pressure chamber, which is connected to a load-sensing pipe, and in a second activation direction opposite to the first activation direction by a pressure downstream of the directional valve arrangement, said pressure downstream acting in a second pressure chamber, the compensation valve having an inlet and an outlet, wherein each working connection is connected to a control system, which amplifies the effect of the pressure in the first pressure chamber on the compensation valve in dependence of a pressure ruling at the working connection;

wherein the outlet of the compensation valve is connected to the directional valve arrangement via a second non-return valve that opens in the direction of the directional valve arrangement.

8. The valve arrangement in accordance with claim 1, wherein the first pressure chamber is connected to a spring.

9. A hydraulic valve arrangement with a supply connection arrangement comprising a high-pressure connection and a low-pressure connection, a working connection arrangement comprising two working connections, which is connected to a motor, a directional valve arrangement located between the supply connection arrangement and the working connection arrangement, and a compensation valve acted upon in a first activation direction by a pressure in a first pressure chamber, which is connected to a load-sensing pipe, and in a second activation direction opposite to the first activation direction by a pressure downstream of the directional valve arrangement, the pressure downstream acting in a second pressure chamber, the compensation valve having an inlet and an outlet, wherein each working connection is connected to a control system, which amplifies the effect of the pressure in the first pressure chamber on the compensation valve in dependence of a pressure ruling at the working connection, wherein the control system pressure-relieves the second pressure chamber.

10. A hydraulic valve arrangement with a supply connection arrangement comprising a high-pressure connection and a low-pressure connection, a working connection arrangement comprising two working connections, which is connected to a motor, a directional valve arrangement located between the supply connection arrangement and the working connection arrangement, and a compensation valve acted upon in a first activation direction by a pressure in a first pressure chamber, which is connected to a load-sensing pipe, and in a second activation direction opposite to the first activation direction by a pressure downstream of the directional valve arrangement, the pressure downstream acting in a second pressure chamber, the compensation valve having an inlet and an outlet, wherein each working connection is connected to a control system, which amplifies the effect of the pressure in the first pressure chamber on the compensation valve in dependence of a pressure ruling at the working connection, wherein the outlet of the compensation valve is connected to the directional valve arrangement via a second non-return valve that opens in the direction of the directional valve arrangement.

* * * * *